United States Patent [19]

Nichols

[11] Patent Number: 4,501,328

[45] Date of Patent: Feb. 26, 1985

[54] METHOD OF CONSOLIDATION OF OIL BEARING SANDS

[75] Inventor: Dean P. Nichols, Dallas, Tex.

[73] Assignee: Mobil Oil Corporation, New York, N.Y.

[21] Appl. No.: 474,952

[22] Filed: Mar. 14, 1983

[51] Int. Cl.[3] ..... E21B 43/02

[52] U.S. Cl. ..... 166/288; 166/276

[58] Field of Search ..... 166/288, 276

[56] References Cited

U.S. PATENT DOCUMENTS

| | | | |
|---|---|---|---|
| 2,427,848 | 9/1947 | Garrison | 166/288 X |
| 3,003,555 | 10/1961 | Freeman et al. | 166/288 |
| 3,104,705 | 9/1963 | Ortloff et al. | 166/288 |
| 3,483,926 | 12/1969 | Bruist | 166/288 |
| 3,522,845 | 8/1970 | Bauer | 166/288 X |
| 3,812,913 | 5/1974 | Hardy et al. | 166/288 |
| 3,871,455 | 3/1975 | Hardy et al. | 166/288 |
| 3,951,210 | 4/1976 | Wu et al. | 166/288 |
| 3,974,877 | 8/1976 | Redford | 166/288 X |

*Primary Examiner*—Stephen J. Novosad
*Assistant Examiner*—Bruce M. Kisliuk
*Attorney, Agent, or Firm*—Alexander J. McKillop; Michael G. Gilman; Charles J. Speciale

[57] ABSTRACT

Wells drilled in poorly consolidated sand formations can be consolidated by heating a portion of the crude oil in situ in the bottom of the well so as to drive off the lighter ends leaving the heavy ends and asphaltenes at the bottom of the well. If additional pressure is then added at the top of the well, the heated fraction is forced into the surrounding cooler formations where it condenses and cools forming a semi-solid material tending to restrain sand from being produced upon further production of the well. The heated fluids will flow into any channels formed in the sand by said production. Continued application of pressure will cause flow channels to be formed in the cooling heavy portion by the light ends, ensuring permeability of the structure.

6 Claims, 2 Drawing Figures

METHOD OF CONSOLIDATION OF OIL BEARING SANDS

FIELD OF THE INVENTION

This invention relates to methods of consolidation of unconsolidated sands in oil bearing formations. More particularly, the invention relates to a method for causing heavier portions of the crude oil found in a generally sandy reservoir to form a semi-solid but permeable coating over the sand whereby production of the sand is substantially reduced.

BACKGROUND OF THE INVENTION

It is well known in the art that wells in sandy, oil-bearing formations are frequently difficult to operate because the sand in the formation is poorly consolidated and tends to flow into the well with the oil. This "sand production" is a serious problem because the sand causes erosion and premature wearing out of the pumping equipment and the like and is a nuisance to remove from the oil at some later point in the production operation. In some wells, particularly in the Saskatchewan area of Canada, the oil with the sand suspended therein must be pumped into large tanks for storage so that the sand can settle out. Frequently, the oil can then only be removed from the upper half of the tank because the lower half of the tank is full of sand. This, too, must be removed at some time and pumped out. Moreover, fine sand is not always removed by this method and this causes substantial problems later in the production run and can even lead to rejection of the sand-bearing oil by the pipe line operator. Accordingly, it has been a well recognized need of the art for some time to provide methods whereby sand production can be avoided in wells of this kind.

Two prior art approaches are shown in U.S. Pat. Nos. 3,951,210 to Wu et al., and 3,003,555 to Freeman et al. These patents both utilize the characteristics of the crude oil found in the sand formation for provision of a semi-solid yet permeable block to the production of sand. Freeman et al use steam in a sealed section of the wall to burn off the lighter ends and to cause the heavier portion of the crude oil, largely carbonaceous material such as asphaltenes to be consolidated in the sand surrounding the well, so as to provide a semi-solid permeable block to the sand. However, such methods are unduly complex and difficult to implement, particularly with respect to the fact that there is a distinct shortage of skilled labor available to perform such tasks.

If anything, the approach of Wu et al is more complicated because it uses solvents as well as steam to separate the asphaltenes from the remainder of the crude oil and to cause them to precipitate to form the hard, permeable sand barrier. Accordingly, this method is not as useful as it might be, although as does Freeman, Wu shows the useful concept of using some component of the crude oil to itself form a block to the production of sand, and shows the concept of separating this portion from the remainder of the crude oil in situ. The present invention follows both of these broad concepts.

OBJECTS OF THE INVENTION

Accordingly, it is an object of the invention to provide an improved method of prevention of sand production in oil wells drilled in poorly consolidated sand formations.

It is a further object of the invention to provide a method for prevention of production of sand in oil wells drilled in poorly consolidated sand formations which is simple and efficient to use, which does not require substantial additional expense and which can be carried out by relatively unskilled personnel.

It is yet another object of the invention to provide a way in which oil production need not be ceased for a substantial length of time in order to effect methods for prevention of production of sand.

Finally, it is an ultimate object of the invention to provide a method whereby crude oil relatively free of sand may be produced from a well drilled into a poorly consolidated sand formation.

SUMMARY OF THE INVENTION

The above needs of the art and objects of the invention are satisfied by the present invention which comprises a method for causing the heavy ends of crude oil present in a poorly consolidated sand formation to form a semi-solid, but permeable barrier to the production of further sand. The method involves the step of allowing the well to fill up with crude oil. A source of heat, preferably an electric heater, is then lowered into the well to a position just above the perforations in the well casing from which the sand has been produced. The heater is operated for a length of time and power is supplied at a rate such that the lighter ends of the crude oil in the vicinity of the heater tend to percolate upward, effectively being separated by the heat while the asphaltenes and other heavy ends tend to remain in the vicinity of the heater. (As used throughout this specification, the terms "asphaltenes" and "heavy ends" are meant to include both asphaltenes and heavy ends.) In an envisioned embodiment a heater on the order of 30 kW power is operated for about 1 to 8 hours to achieve this result. Overpressure is then applied to the top of the well. The asphaltenes and heavy ends, by now far less viscous then when at the reservoir temperature, are forced back out through some of the perforations in the casing and into the formation where they contact the cooler formation sands. This causes the asphaltenes and heavy ends to condense and solidify in any void spaces formed in the formation by production of sand, and to generally coat the grains of the sand in such a way that a semi-solid yet permeable asphaltene barrier is formed to the production of further sand. Specifically, the unfavorable mobility ratio of the hot, thin fluid when displacing cold viscous reservoir oil is expected to create capillary-size "fingers" that extend much further into the formation than would the same amount of material undergoing a simple radial displacement. The fluid at the periphery of the capillaries should start to adhere to the sand grains when the viscosity of the heavy components increases upon cooling. This "condensed film" will bind the sand grains. Continued application of overpressure can cause the lighter portion of the crude oil in the well to flow through weaker or missing spaces in the asphaltene "coating", so as to keep flow channels through the asphaltene coating on the formation sands open, thus ensuring a permeable and hence producible formation. Since the asphaltenes once condensed are relatively insoluble in crude oil, the coating will tend to remain in place during further production.

BRIEF DESCRIPTION OF THE DRAWINGS

The invention will be better understood if reference is made to the accompanying drawings, in which.

DESCRIPTION OF THE PREFERRED EMBODIMENTS

As discussed above, this invention relates to the formation of a semi-solid but permeable block to production of formation sand and generally comprises the steps of separation in a well of the heavy ends of the crude oil from the lighter ends, heating these heavy ends to greatly reduce their viscosity, and then forcing these heated heavy ends into the formation where they cool into a semi-solid structure in such a way that the formation remains permeable yet by which a barrier to the production of sand is formed.

Figure 1:
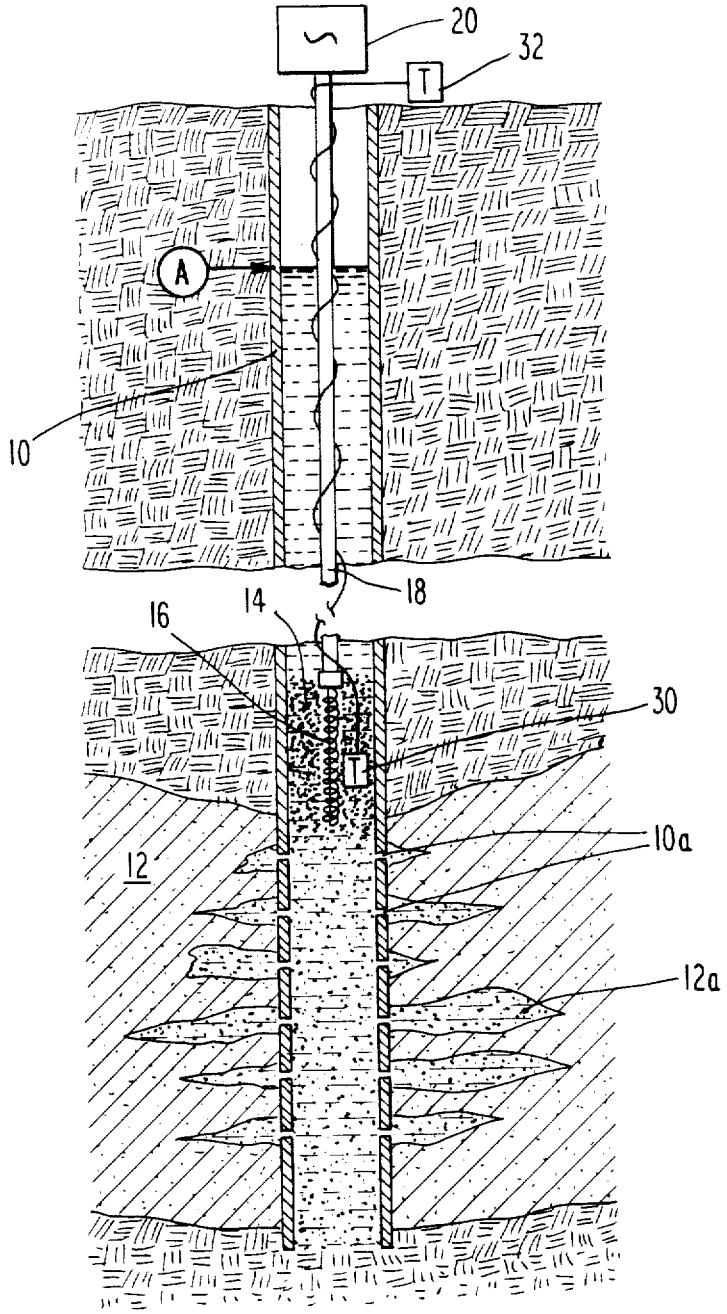
FIG. 1 shows an overall view of a well in an unconsolidated sand formation showing the formation of voids, and shows a portion of the process of the invention.

FIG. 1 shows schematically a well in which this procedure might be carried out. It comprises a well casing 10 which defines a well bore 14. Perforations 10*a* are formed in the region of an oil bearing sand formation 12. Typically such a well in the Alberta/Saskatchewan border area of Canada will be about 1500 feet deep. The pressure of the oil at the bottom of the well will be about 500 psi and its temperature about 70° F. Under these conditions the oil flows under its own pressure out of the formation 12 through the perforations 10*a* in the casing 10 and upwardly to a point A in the well bore 14. Typically, after perforation this pressure will be sufficient to force the oil to rise slowly to within about 400 feet of the surface whereupon it is pumped in a conventional manner in the surface. It is noted, however, that the sands of these formations 12 are typically very poorly consolidated and accordingly tend to flow into the well with the crude oil which is highly undesirable for a variety of reasons all well understood in the art. For example, the sand causes significant erosion problems with the oil handling equipment, e.g., causing pumps to seize, and is difficult to remove from the oil later in the production stream. Also, voids 12*a* are formed in the formation which can lead, in extreme cases, to collapse of the formation and destruction of the well. Accordingly, it is desired that means be provided to prevent production of sand in a well of this kind.

The present invention does this by lowering an electric heater 16 into the crude oil in the well bore 14. If electric power is then applied to the heater by means of wires 18 from a power source 20 the light ends, being of lower molecular weight than the heavy ends and hence more readily distillable, will tend to rise towards the upper portion of the well leaving the heavy ends, particularly asphaltenes, in the vicinity of the heater. The crude oil in the well bore 14 below the heater will tend to remain the same general mix of light and heavy ends as in the formation, because the heat supplied will tend generally to flow upwardly in accordance with the well known convection principle. It is desirable that the heat be thus confined to the well bore, so that the separation takes place effectually. Application of heat above the zone of production, as shown, also avoids damage to the cement (not shown) sealing the drill casing to the surrounding rock formation. It is envisoned that in a well of 7 inches or smaller inside diameter one would use about a 15 foot electric heater rated at about 30 kW to heat about 15 feet of the contents of the well to separate the light and heavy ends as discussed above. Such electric heaters are commercially available and form no part of the present invention. The down hole output of the heater 16 should be about 1–1.5 kW per foot which if operated for on the order of one to eight hours (dependent on well diameter, effective heat loss, and the like) should be sufficient to raise the temperature of the oil in the vicinity of the heater to at least about 500° F., and possibly up to about 750° F., which can be expected to effect the heavy/light ends separation as discussed above. In general, it is envisioned that a temperature transducer 30 in the vicinity of the heater 16 and a monitoring device 32 would be used to monitor the actual well temperature achieved, rather than relying only on the power input.

Figure 2:
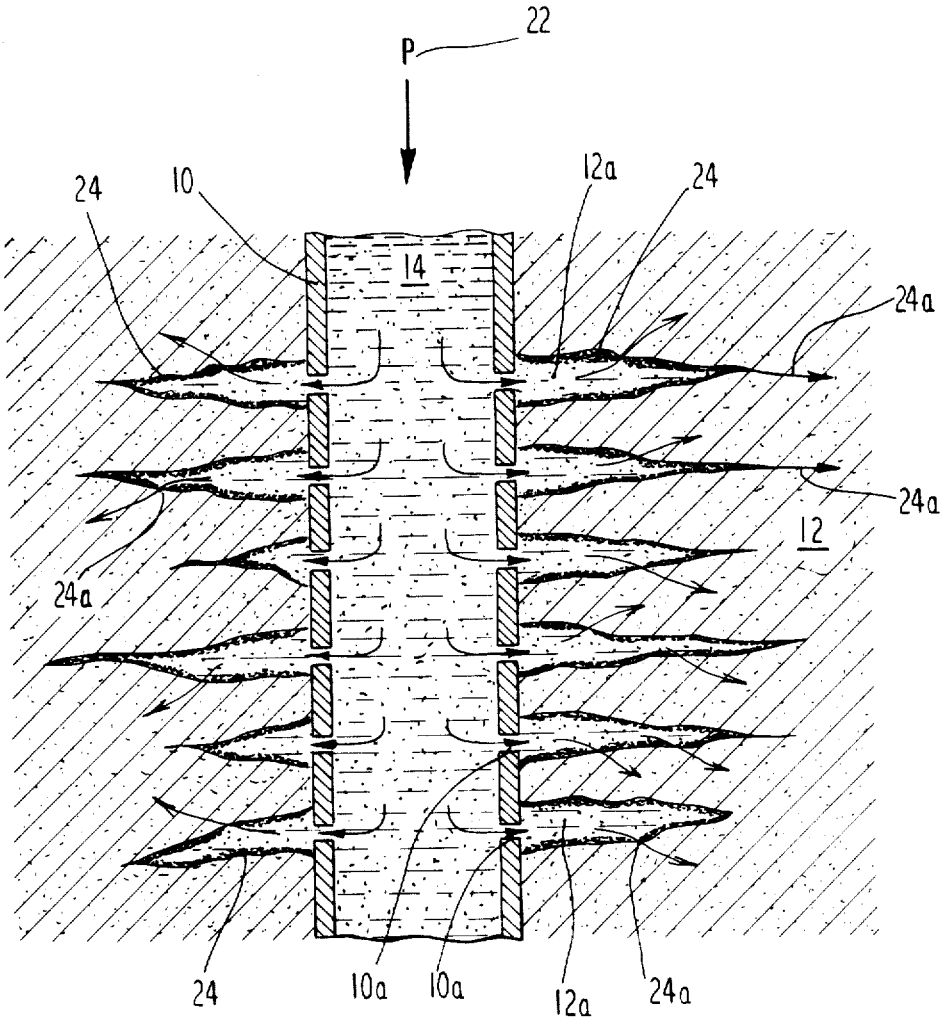
FIG. 2 shows a view comparable to FIG. 1 of the production portion of the well and exhibits how the method of the invention results in a semi-solid but permeable coating on the formation which prevents the production of sand.

It will be appreciated that the viscosity of the asphaltenes portion of the oil will be very greatly reduced by this heating, perhaps reduced to about 50–100 centipoise as compared with 100,000 centipoise range when at the formation temperature. If pressure is then applied as at 22 in FIG. 2, the mixture of the light and heavy ends beneath the separated portion of the heavy ends in the vicinity of the heater 14 is first pushed back into the formation through the voids 12*a*. Thereafter, the heated asphaltenes of reduced viscosity flow through the perforations 10*a* and into the formation 12. However, as the asphaltenes strike the cool formation, they tend to condense forming a heavy and viscous fluid, and eventually a semi-solid mass, when they have contacted the formation 12 to a sufficient degree. In laboratory testing under pressure to simulate the well bore, the heavy ends became substantially solid when cooled to 70° F. This is shown generally in FIG. 2 where a coating 24 of asphaltenes is shown on the inner walls of the voids 12*a*. Flow capillaries such as shown by arrows 24*a* are also expected to be formed due to the fingering effect well known to the art to occur when a thin fluid (here the heated, low-viscosity heavy ends) penetrates a cooler formation. It should be appreciated that the voids 12*a* are shown in a highly idealized way and that they might be quite small relative to the diameter of the well bore. Note also that it might be desirable to perform the method of the invention at the time of the original completion of a well, i.e., prior to actually removing any oil therefrom so as to seal the formation before voids have an opportunity to be formed.

The pressure could be applied as at 22 by a variety of means. One of the simplest would be simply to pour ten or fifteen barrels of crude oil into the top of the well. The weight of this oil is expected to be sufficient to cause the asphaltene portions to flow into the reservoir through the voids 12*a* thus ensuring that the sand of the reservoir is fully coated by the alphaltene before it solidifies. Further application of pressure as at 22 would cause the lighter ends and unseparated oil in the upper portion of the well to flow back downwardly into the formation which might be useful as well in establishing flow channels in the by now more or less congealed asphaltene material, thus ensuring that the structure thus formed at the bottom of the well remains permeable.

It will be appreciated by those skilled in the art that the odds are good that the asphaltenes will flow into any void spaces 12*a* which exist, thus fully coating those portions of the unconsolidated sand formation 12 which need it most, a very useful phenomenon. Similarly, it will be apparent to those skilled in the art that as the asphaltene once congealed is not soluble in crude oil, further production of the well should not cause undue erosion of the asphaltene coating in the production portion of the well.

Finally, it will be appreciated by those skilled in the art that no combustion, solvents or chemical reactions are required in order to perform the method of the invention. Instead, one need merely apply electric power to a very uncomplicated and conventional electric heater until the desired temperature is reached in the heated zone, then apply pressure at the top of the well, and permit the asphaltenes to cool once in contact with the formation sands. Accordingly the method of the invention is quite simple and should not require the presence of skilled personnel for its performance, as do the prior art methods discussed above.

It will ultimately be appreciated by those skilled in the art that numerous modifications and improvements to the method of the invention (including repetitive performance thereof) are possible and that therefore the scope of the invention should not be considered to be limited by the above disclosure but only by the following claims.

I claim:

1. A method of forming a semi-solid but permeable coating on unconsolidated sand formations surrounding an oil well, comprising the steps of:

allowing said well to fill with oil;

heating a portion of the oil in said well, said heat being applied at a rate and for a period of time such that the oil juxtaposed to the source of the heat is separated into a lighter fraction and a heavier fraction, said heat being applied to said well at a point above the region of oil production in said well, whereby the fluid in the well in the vicinity of any voids caused by production in said well is not substantially heated;

permitting said lighter fraction to migrate generally upwardly in said well;

applying pressure to the upper end of said well, forcing the heavier fraction downwardly and out into said formation, through any such voids; and permitting said heavier fraction to be cooled by contact with said formation, whereby said sand is generally consolidated by said heavier fraction having cooled into a semi-solid but permeable coating on said formation.

2. The method of claim 1 wherein said source of heat is an electric heater.

3. The method of claim 1 wherein said oil in the well in the general vicinity of the source of heat is heated to a temperature of at least about 500° F.

4. A method of consolidating oil-bearing sand formations surrounding a well, said well being defined by a casing perforated in the vicinity of said oil-bearing sands, comprising the steps of:

heating a portion of the oil in said well, whereby the lighter fraction of the oil is driven upwardly with respect to the source of heat employed, leaving the heavier fraction of the oil in the vicinity of said source of heat, wherein said heat is applied to a degree such that the viscosity of said heavier fraction is reduced substantially as compared to its viscosity at the temperature of the formation and wherein said source of heat is located with respect to the perforations in the casing such that only the oil located at a point above said perforations in said well is heated by said source of heat;

applying pressure to the upper end of said well, to drive said heated heavier fraction downwardly and out through the perforations in said casing and into said formation; and permitting said heavier fraction to cool in contact with said formation, whereby a semi-solid but permeable formation is formed of the sand surrounding said casing and of the solidified heavier fraction of the oil.

5. The method of claim 4 wherein said source of heat is an electric heater.

6. The method of claim 4 wherein the oil heated by said source of heat is heated to at least about 500° F.

* * * * *